US011097170B1

(12) United States Patent
Owens

(10) Patent No.: US 11,097,170 B1
(45) Date of Patent: Aug. 24, 2021

(54) GOLF CLUB AND PUTTER STAND

(71) Applicant: Jerry Ray Owens, Moodus, CT (US)

(72) Inventor: Jerry Ray Owens, Moodus, CT (US)

( * ) Notice: Subject to any disclaimer, the term of this patent is extended or adjusted under 35 U.S.C. 154(b) by 0 days.

(21) Appl. No.: 16/948,725

(22) Filed: Sep. 30, 2020

Related U.S. Application Data

(60) Provisional application No. 62/884,030, filed on Aug. 7, 2019.

(51) Int. Cl.
*A63B 55/10* (2006.01)

(52) U.S. Cl.
CPC ..... *A63B 55/10* (2013.01)

(58) Field of Classification Search
CPC ..... A63B 55/10
See application file for complete search history.

(56) References Cited

U.S. PATENT DOCUMENTS 5,230,507 A * 7/1993 White ..... A63B 55/10 206/315.3
5,413,329 A * 5/1995 Hirsch ..... A63B 55/10 211/70.2
5,482,247 A * 1/1996 Smith ..... A63B 69/3685 248/688
5,492,230 A * 2/1996 Horton ..... A63B 55/10 211/196
5,782,704 A * 7/1998 Tetler ..... A63B 55/10 211/70.2
6,283,875 B1 * 9/2001 Jones ..... A63B 55/10 211/70.2
6,428,422 B1 * 8/2002 Bennett ..... A63B 55/10 248/520
7,197,844 B2 * 4/2007 Benson ..... F41A 23/08 248/593
7,771,287 B2 * 8/2010 Staszak ..... A63B 55/10 473/282
8,256,610 B2 * 9/2012 Michas ..... A45F 3/04 206/315.7
8,512,163 B2 * 8/2013 McDowell ..... A63B 57/353 473/282
D735,829 S * 8/2015 Bagshot ..... D21/796
D812,371 S * 3/2018 Horne ..... D3/221
D903,024 S * 11/2020 Mickley ..... D21/789
2007/0202961 A1 * 8/2007 Andren ..... A63B 55/10 473/282
2014/0128172 A1 * 5/2014 Basile ..... A63B 69/36213 473/229

FOREIGN PATENT DOCUMENTS

GB 2485841 A * 5/2012 ..... A63B 55/10
GB 2519585 A * 4/2015 ..... A63B 55/10

* cited by examiner

*Primary Examiner* — Stephen L Blau
(74) *Attorney, Agent, or Firm* — Dunlap Bennett & Ludwig, PLLC

(57) ABSTRACT

A golf club stand of unitary construction having a snap on open collar and two supporting legs that downwardly and outwardly extend away from the open collar in a mirrored configuration. Each supporting leg ends in feet that rest on a supporting surface, such as anyplace along a golf course, so that when a shaft of a golf club is snapped into the open collar, the golf club stands in a upright orientation with the support of the feet, making the golf club highly visible.

10 Claims, 4 Drawing Sheets

GOLF CLUB AND PUTTER STAND

CROSS-REFERENCE TO RELATED APPLICATION

This application claims the benefit of priority of U.S. provisional application No. 62/884,030, filed 7 Aug. 2019, the contents of which are herein incorporated by reference.

BACKGROUND OF THE INVENTION

The present invention relates to golfing accessories and, more particularly, a golf club stand of unitary construction, wherein the golf club stand snaps on to the shaft of the club for propping the golf club up on a supporting surface, such as along any surface of the golf course, in an upright position, thereby making the retained golf club highly visible.

Leaving golf clubs behind on the golf course is an annoyance many golfers have had to endure. Currently, golf club stands do not work well when the ground gets hard, and they cannot be used on the greens since they purposefully leave marks or indentations in their supporting surface.

As can be seen, there is a need for a golf club stand of unitary construction, wherein the golf club stand snaps on to the shaft of the club for propping the golf club on a supporting surface by way of non-invasive feet in an upright position.

The present is adapted to snap on easily and can be used in any conditions and anywhere on the golf course so that the golf club is highly visible in the upright position so as not to be forgotten on the golf course.

Furthermore, being a unitary condition, the golf club stand embodied by the present invention is inexpensive and efficient to mass produce.

SUMMARY OF THE INVENTION

In one aspect of the present invention, a golf club/putter stand includes the following: an open collar having an open width defined by two curved shoulders; and a supporting leg extending downwardly and outwardly from each curved shoulder in a mirrored configuration.

In another aspect of the present invention, the golf club/putter stand includes the following: an open collar having an open width defined by two curved shoulders, wherein the open width is dimensioned to provide a snap on functionality for a shaft of a golf club; a supporting leg extending downwardly and outwardly from each curved shoulder in a mirrored configuration; and a foot extends from a distal end of each supporting leg, each foot is parallel with the open collar and each foot extends away from the other foot, wherein the open collar is at least six inches away from each foot, and wherein the open collar, two curved shoulders, each supporting leg, and each foot is fabricated from a single material in a unitary construction.

In yet another aspect of the present invention, a method of manufacturing a golf club stand from a unitary material, the method includes the following: providing the unitary material having both a length-to-width ratio of at least twenty to one, and a width-to-thickness ratio ranging between three to one to six to one; and forming, by additive manufacture or injection molding, the unitary material into the following: an open collar having an open width defined by two curved shoulders; a supporting leg extending downwardly and outwardly from each curved shoulder in a mirrored configuration; and a foot extends from a distal end of each supporting leg so that each foot is parallel with the open collar and each foot extends away from the other foot.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a golf club stand of unitary construction having a snap on open collar and two supporting legs in a mirrored configuration. Each supporting leg ends in feet that rest on a supporting surface, such as anyplace along a golf course, so that when a golf club is snapped into the open collar, the golf club stands in a upright orientation with the support of the feet, making the golf club highly visible.

Figure 1:
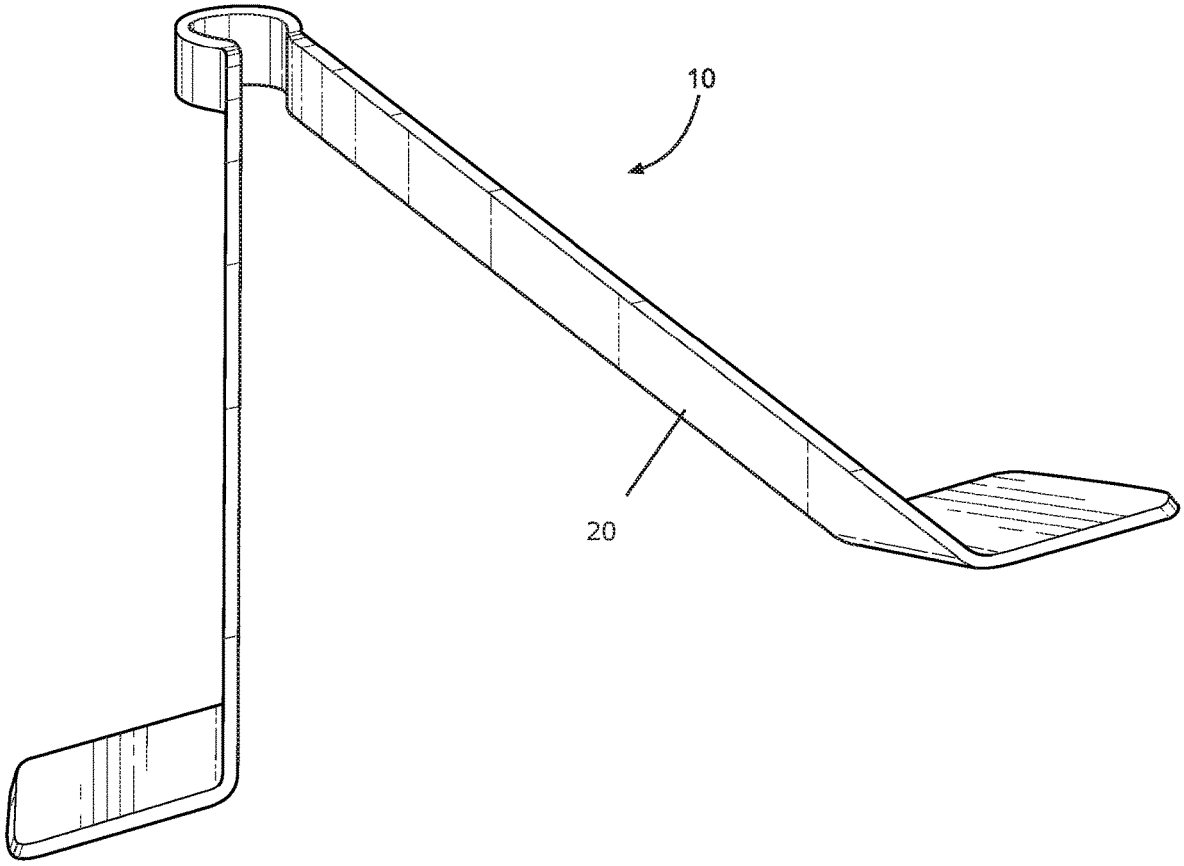
FIG. 1 is a perspective view of an exemplary embodiment of the present invention.
Figure 2:
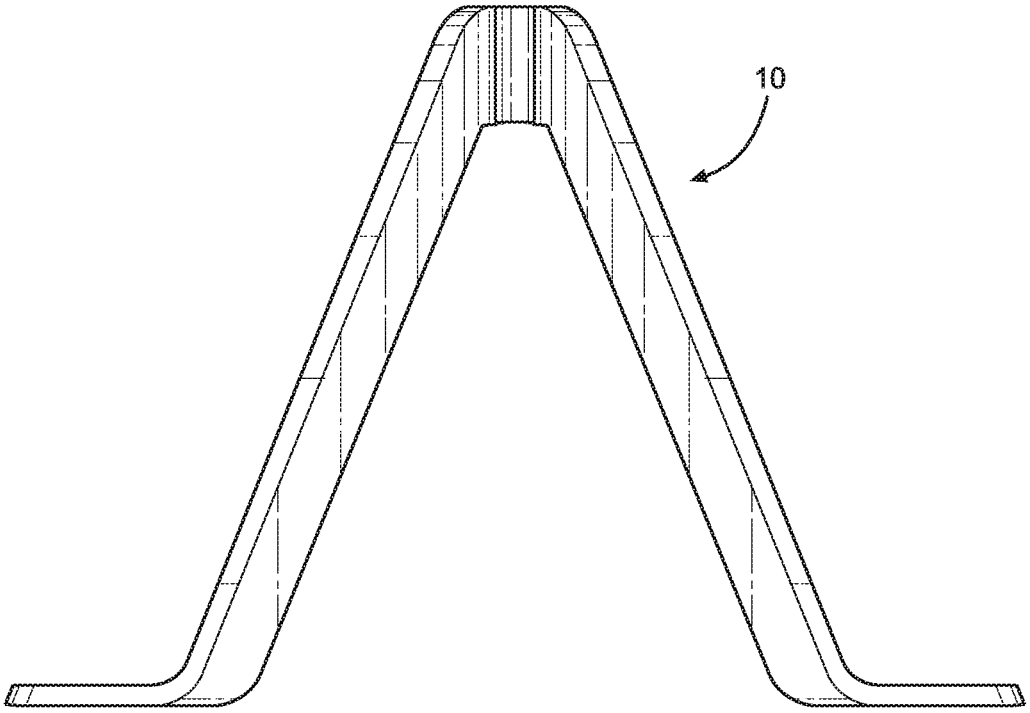
FIG. 2 is a rear elevation view of an exemplary embodiment of the present invention.
Figure 3:
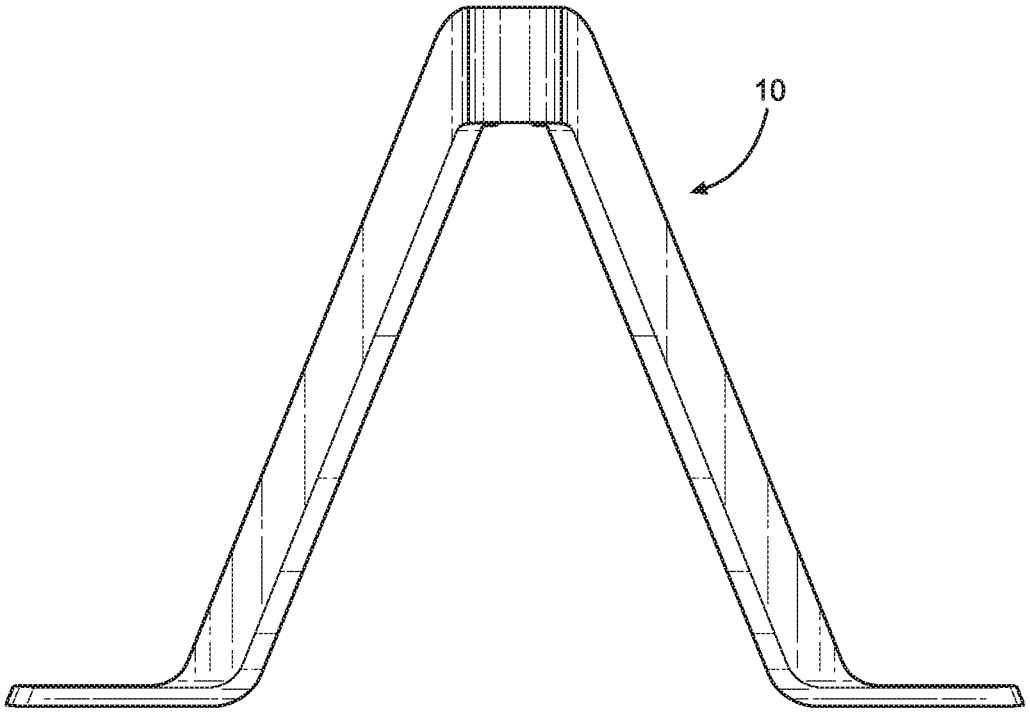
FIG. 3 is a front elevation view of an exemplary embodiment of the present invention.
Figure 4:
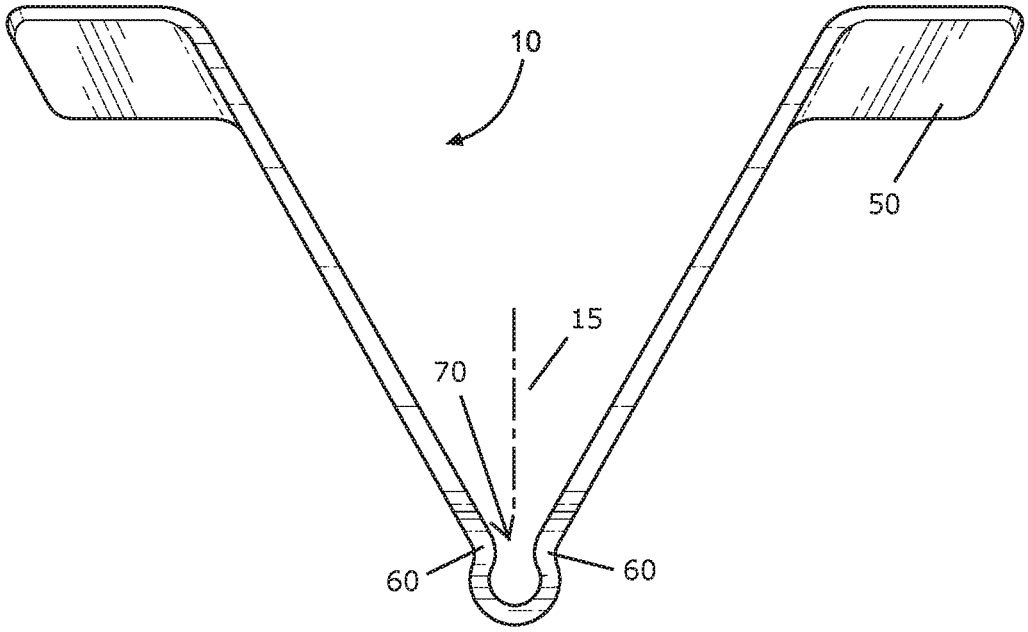
FIG. 4 is a top plan view of an exemplary embodiment of the present invention.
Figure 5:
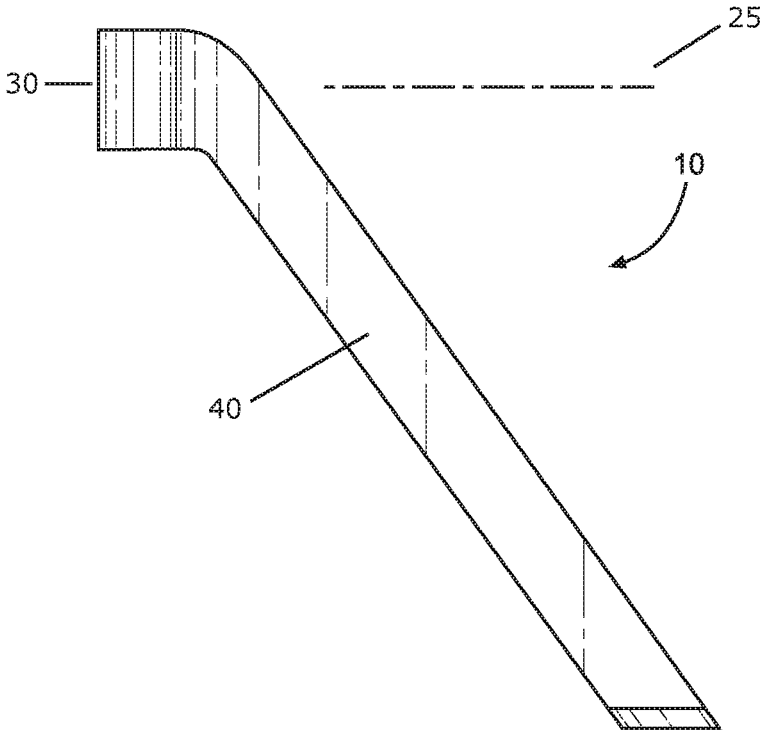
FIG. 5 is a side elevation view of an exemplary embodiment of the present invention.
Figure 6:
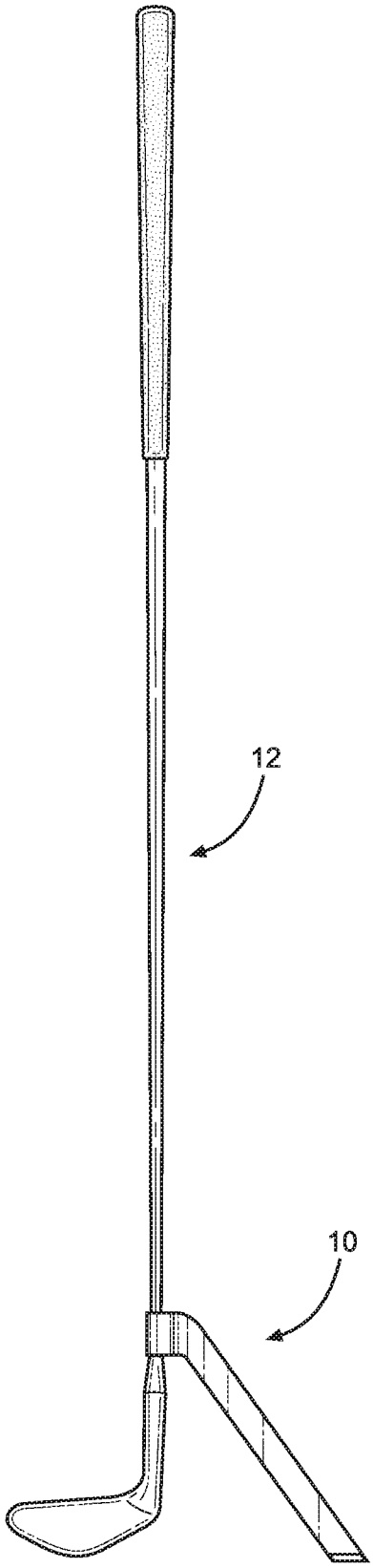
FIG. 6 is a side elevation view of an exemplary embodiment of the present invention shown in use.
Figure 7:
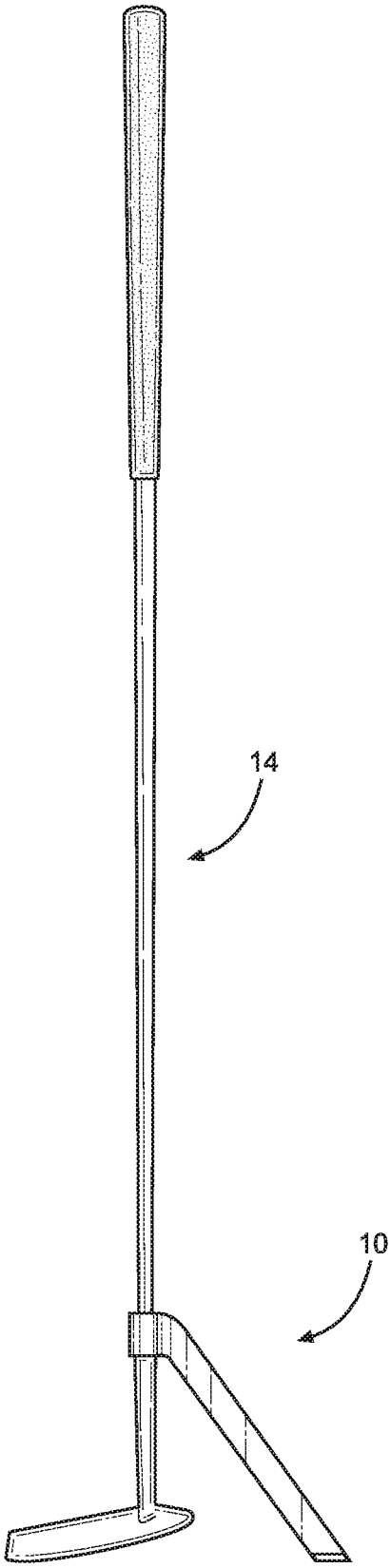
FIG. 7 is a side elevation view of an exemplary embodiment of the present invention shown in use.

Referring now to FIGS. 1 through 7, the present invention may include golf club stand 10 of a unitary construction whereby fabrication would require but one material formed through injection molding, additive manufacture, or the like, resulting in an inexpensively mass produced solution that can be used anywhere on a golf course. It should be understood that the golf club 10 could include any golf club in the golf bag—wedge, driver, putter, etc.

The golf club stand 10 may be formed from a member 20 of unitary construction. Unitary construction may include construction through a single material, including various plasticized materials, metallic materials, synthetic materials, or the like. The member 20 is elongated: having a length-to-width ratio of at least twenty to one. The member 20 may have a width-to-thickness ratio ranging between three to one to six to one.

The member 20 forms, in part, an open collar 30 that completes between 225 and 300 degrees of a defined lumen. Two supporting legs 40 veer outward and downward from opposing ends of the opening (or open width) 70 defined by the open collar 30, forming a curved shoulder 60 on each side of said open width 70.

The open width 70 is dimensioned, adapted and determined by a desired amount of compressibility of the shoulder when loaded with a golf club shaft 12 or 14. Specifically, the open width 70 provides adequate space between the shoulders 60 so that both shoulders 60 must be urged away from each other by said golf club shaft 12 or 14 in order for the golf club shaft 12 or 14 to pass into the lumen of the open collar 30, at which time the shoulders 60 compress toward one another due to their resilient, biased nature—effectuating a 'snap on' functionality—whereby the open width 70 moves back to a distance slightly less than a width of said golf club shaft 12 or 14, preventing the golf club shaft 12 or 14 from escaping in the absence of external, non-gravitational force.

Two supporting legs 40 veer outward and downward: the outward angle is defined by a first plane 15 passing through a center of the open collar 30, bisecting the open collar 30, wherein the outward angle for each leg 40 may be fifteen to thirty degrees relative to the first plane 15. The downward angle ranges between forty-five and sixty degrees relative to a second plane 25 shared by the entirety of open collar 30 and the second plane 25 being orthogonal to the first plane 15. Each leg 40 ends with a foot 50 extending from a distal end of the leg 40 so that each foot 50 is parallel with the second plane 25 and extending away from the other foot 50.

A method of using the present invention may include the following. The golf club stand 10 disclosed above may be provided. The golf club stand 10 snaps easily onto the golf club shaft 12 or 14 to stand the golf club in an upright position on the golf club's end in conjunction of the two spaced apart feet 50 along a supporting surface, thereby the golf club is highly visible and will never be left behind.

It should be understood, of course, that the foregoing relates to exemplary embodiments of the invention and that modifications may be made without departing from the spirit and scope of the invention as set forth in the following claims.

What is claimed is:

1. A golf club stand comprising:

an open collar having an open width defined by two curved shoulders; and a supporting leg extending downwardly and outwardly from each curved shoulder in a mirrored configuration.

2. The golf club stand of claim 1, further comprising:

a foot extends from a distal end of each supporting leg in such a way that each foot is parallel with the open collar and each foot extends away from the other foot.

3. The golf club stand of claim 2, wherein the open collar, two curved shoulders, each supporting leg, and each foot is fabricated from a single material in a unitary construction.

4. The golf club stand of claim 2, wherein the open collar is at least six inches away from each foot.

5. The golf club stand of claim 1, wherein the open width is dimensioned to provide a snap on functionality for a shaft of a golf club.

6. The golf club stand of claim 5, wherein the open width is dimensioned in such a way that the two curved shoulders are urged away from each when receiving said shaft in the snap on functionality.

7. The golf club stand of claim 6, wherein the two curved shoulders are resilient so as to be biased to form the open width when not urged by an external force.

8. A golf club stand comprising:

an open collar having an open width defined by two curved shoulders, wherein the open width is dimensioned to provide a snap on functionality for a shaft of a golf club;

a supporting leg extending downwardly and outwardly from each curved shoulder in a mirrored configuration; and a foot extends from a distal end of each supporting leg, each foot is parallel with the open collar and each foot extends away from the other foot, wherein the open collar is at least six inches away from each foot, and wherein the open collar, two curved shoulders, each supporting leg, and each foot is fabricated from a single material in a unitary construction.

9. A method of manufacturing a golf club stand from a unitary material, the method comprising:

providing the unitary material having both a length-to-width ratio of at least twenty to one, and a width-to-thickness ratio ranging between three to one to six to one; and forming, by additive manufacture or injection molding, the unitary material into the following:

an open collar having an open width defined by two curved shoulders;

a supporting leg extending downwardly and outwardly from each curved shoulder in a mirrored configuration; and a foot extends from a distal end of each supporting leg so that each foot is parallel with the open collar and each foot extends away from the other foot.

10. The method of claim 9, wherein the unitary material is a plasticized material.

* * * * *